US006389142B1

(12) United States Patent
Hagen et al.

(10) Patent No.: US 6,389,142 B1
(45) **Date of Patent: *May 14, 2002**

(54) IN-THE-EAR HEARING AID WITH DIRECTIONAL MICROPHONE SYSTEM

(75) Inventors: Lawrence T. Hagen, Minneapolis; David A. Preves, Minnetonka, both of MN (US)

(73) Assignee: Micro Ear Technology, Plymouth, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/052,631

(22) Filed: Mar. 31, 1998

Related U.S. Application Data

(63) Continuation-in-part of application No. 08/763,520, filed on Dec. 11, 1996, now Pat. No. 5,757,933.

(51) Int. Cl.[7] ..... H04R 25/00
(52) U.S. Cl. ..... 381/313; 381/92; 381/328
(58) Field of Search ..... 381/23.1, 92, 122, 381/312, 313, 320, 321, 356, 315

(56) References Cited

U.S. PATENT DOCUMENTS

| | | | | |
|---|---|---|---|---|
| 3,571,514 A | | 3/1971 | Wruk | 179/1 |
| 3,770,911 A | | 11/1973 | Knowles et al. | 179/107 S |
| 3,798,390 A | | 3/1974 | Gage et al. | 179/107 FD |
| 3,836,732 A | | 9/1974 | Johanson et al. | 179/107 FD |
| 3,875,349 A | | 4/1975 | Ruegg | 179/107 FD |
| 3,946,168 A | | 3/1976 | Preves | 179/107 FD |
| 3,975,599 A | | 8/1976 | Johanson | 179/107 FD |
| 4,051,330 A | | 9/1977 | Cole | 179/107 FD |
| 4,142,072 A | | 2/1979 | Berland | 179/107 FD |
| 4,449,018 A | * | 5/1984 | Stanton | 179/107 |
| 4,456,795 A | | 6/1984 | Saito | 179/107 H |
| 4,622,440 A | | 11/1986 | Slavin | 381/68.1 |
| 4,712,244 A | | 12/1987 | Zwicker et al. | 381/68.1 |
| 4,723,293 A | | 2/1988 | Harless | 381/68 |
| 4,751,738 A | | 6/1988 | Widrow et al. | 381/68.1 |
| 5,029,215 A | | 7/1991 | Miller, II | 381/92 |
| 5,214,709 A | | 5/1993 | Ribic | 381/68.1 |
| 5,226,087 A | | 7/1993 | Ono et al. | 381/92 |
| 5,289,544 A | | 2/1994 | Franklin | 381/68.1 |
| 5,483,599 A | * | 1/1996 | Zagorski | 381/68.1 |
| 5,524,056 A | | 6/1996 | Killion et al. | 381/68.2 |

* cited by examiner

*Primary Examiner*—Binh Tieu
*Assistant Examiner*—Suhan Ni
(74) *Attorney, Agent, or Firm*—Schwegman, Lundberg, Woessner & Kluth, P.A.

(57) ABSTRACT

Apparatus for use as an in-the-ear hearing aid. The apparatus includes a housing having a shell and a face plate, wherein the shell is molded to custom fit a hearing aid wearer's ear. A first non-directional microphone system is included having a first output signal representative of the sound received. A second non-directional microphone system is included having a second output signal representative of the sound received. A switch mechanism is included having an operator extending through the housing for switching the in-the-ear hearing aid between a non-directional mode and a directional mode. In the directional mode, the microphone system is adjustable to account for component tolerances. The switched directional/non directional microphone feature is employed in a custom in-the-ear Contralateral Routing of Signals (CROS) or Bilateral Routing of Signals (BiCROS) two instrument hearing aid system.

42 Claims, 9 Drawing Sheets

16A
16B
102
120
HEARING AID AMPLIFIER
76A
OPAMP2
R8A
C5A
76B
OPAMP2
C4B
R6B
71A
S3A
74B
S4B
R10A
R9A
R7A
R4B
R5B
R3B
54A
54B
52A
72A
OPAMP1
R12A
C8A
C3B
R2B
72B
OPAMP1
52B
70A
70B
R11A
R1B
C7A
C6A
C1B
C2B
MIC B1
MIC F1
MIC F2
MIC B2
HEARING AID 1
HEARING AID 2

IN-THE-EAR HEARING AID WITH DIRECTIONAL MICROPHONE SYSTEM

CROSS REFERENCE TO RELATED APPLICATIONS

This application is a continuation-in-part of application Ser. No. 08/763,520 filed on Dec. 11, 1996 now U.S. Pat. No. 5,757,933.

BACKGROUND OF THE INVENTION

The present invention relates to a microphone system which may be used with an in-the-ear hearing aid system. In particular, the present invention relates to an adjustable microphone system, which may be used with an in-the-ear hearing aid, which allows the wearer to switch between a non-directional (or omni-direction) mode or a directional mode.

Typical hearing aids either include a non-directional or directional hearing aid system. A non-directional hearing aid system allows the wearer to pickup sounds from any direction. When a hearing aid wearer is trying to carry on a conversation within a crowded room, a non-directional hearing aid system does not allow the wearer to easily differentiate between the voice of the person the wearer is talking to and background or crowd noise. A directional hearing aid helps the wearer to hear the voice of the person he or she is having a conversation with, while reducing the miscellaneous crowd noise present within the room.

Traditionally, directional hearing aids are implemented with a single microphone having inlets to cavities located in front and back of a diaphragm. Directionality with a single microphone is accomplished with an acoustic resistor placed across a hole in the back inlet of the microphone acting in combination with the compliance formed by the volume of air behind the diaphragm. This system is termed a first order pressure gradient directional microphone because the microphone output is a function of the pressure differential across the diaphragm.

One measure of the amount of directivity of a directional hearing aid system is a polar directivity pattern 10 as shown in FIG. 1. The polar directivity pattern 10 shows the amount of pickup at a specific frequency (in terms of attenuation in dB) of a directional hearing aid system as a function of azimuth angle of sound incidence. Accurate measurement of a polar directivity pattern requires an anechoic chamber. An anechoic chamber is an enclosed room that has minimum reflection of sound from its inner wall surfaces and that attenuates ambient sounds entering from the outside. Thus, inside an anechoic chamber, the direction of arrival of sound can be controlled so that it comes from only one specific angle of incidence.

A cardioid or heart-shaped polar pattern produces a directivity index of about 3–4 dB. The directivity index is the ratio of energy arriving from in front of the hearing aid wearer to the random energy incident from all directions around and imaginary sphere with the hearing aid at its center. However, a super cardioid polar pattern 14, as shown in FIG. 2, which can also be obtained with a first order pressure gradient directional hearing aid microphone, produces a 5–6 dB directivity index. It has been found that producing a super-cardioid polar pattern 14 requires 1.72 times greater front-to-rear microphone port spacing than a cardioid polar pattern 12. Because of limited space, a super cardioid directivity pattern is more difficult to achieve using a single directional microphone in a full-concha custom in-the-ear hearing device.

Conventional behind-the-ear type hearing aids have included a main body and a hook extending from the main body and arrange to engage the upper end of the ear lobe of the wearer to hang the main body on the ear. Known versions of behind-the-hearing aids that had variable amounts of directionality use mechanical shutters or valves to adjust the amount of directionality. For example, see U.S. Pat. No. 3,798,390 to Gage et al.; U.S. Pat. No. 3,836,732 to Johanson et al.; and U.S. Pat. No. 4,051,330 to Cole. Other known behind-the-ear hearing aid systems, such as U.S. Pat. No. 5,214,709 to Ribic suggests a behind-the-ear hearing aid system which includes the use of more than one non-directional microphone to make a directional microphone behind-the-ear hearing aid system.

Persons with an unaidable unilateral hearing loss or persons having one ear that cannot be aided with a hearing aid (known as a dead ear) and one ear with some aidable hearing loss often have great difficulty communicating in high noise levels. In such hearing loss configurations, this difficulty occurs because of the loss of the auditory system's normal ability to suppress noise, which is the expected result of the cross-correlation capability of the brain using the balanced, fused, binaurally-processed inputs from the two normal cochleas of a normal hearing person.

Contralateral Routing Of Signals (CROS) and Bilateral Routing of Signals (BiCROS) hearing aids, respectively, are often employed for such persons since they often have great difficulty wearing only one hearing aid. In essence, two instrument CROS and BiCROS systems take sound from the bad ear, process it, then send the processed sound via hard wire, RF, or induction transmission to a receiver in the other ear.

CROS systems are utilized for individuals with one unaidable ear and one ear with normal hearing or a mild hearing loss. A microphone is worn on the unaidable ear, and the receiver is worn on the better ear. BiCROS systems are utilized for individuals having one unaidable ear and one ear needing amplification. In the BiCROS system, a microphone is worn on each ear, and the receiver is worn on the better ear. CROS and BiCROS hearing aids overcome the loss of about 6 dB caused by the head blocking and diffracting sounds incident to one ear (the dead side) as they cross over to the better ear.

It is desirable to have an in-the-ear hearing aid system which allows the wearer to switch between a non-directional (omni-directional) and a directional hearing aid mode. Further, it is desirable to have an in-the-ear hearing aid system having an adjustable directional microphone system, wherein the adjustable directional microphone system. Further, it is desirable to have an in-the-ear hearing aid microphone system having an adjustable directional microphone system to allow compensation for small ears where the microphone inlets cannot be spaced far apart. It is also desirable to have an in-the-ear hearing aid microphone system which allows the in-the-ear hearing aid microphone system to be adjusted for manufacturing tolerances between the individual microphones. Finally, it is desirable to have a CROS or BiCROS hearing aid which offers a switched directional/non-directional capability.

SUMMARY OF THE INVENTION

The present invention includes an apparatus for use as an in-the-ear hearing aid. The apparatus includes a housing having a shell and a face plate, wherein the shell is molded to custom fit a hearing aid wearer's ear. A first non-directional microphone system is included having a first inlet opening in the face plate for receiving sound, and having a first output signal representative of the sound received. A second non-directional microphone system is included having a second inlet opening in the face plate for receiving sound and having a second output signal representative of the sound received. A switch mechanism is provided having an operator extending through the housing for switching the in-the-ear hearing aid between a non-directional mode and a directional mode.

The switch has an open position and a closed position. When the switch is in the closed position, the in-the-ear hearing aid operates in a directional mode. When the switch is in an open position, the in-the-ear hearing aid operates in a non-directional mode.

The apparatus may further include means for summing, selectively coupled to the first non-directional microphone system and the second non-directional microphone system, having a summed output signal representative of the sum of the first output signal and the second output signal. When the hearing aid is in the directional mode, the output signal has a polar directivity pattern representative of the summed output signal, the means for summing may further comprise means for adjusting the polar directivity pattern of the summed output signal. The means for adjusting the polar directivity pattern may include an inverting amplifier coupled to the second microphone system, and an adjustable low pass filter coupled to the inverting amplifier. In one embodiment, the adjustable phase delay includes an adjustable phase delay having an adjustable capacitor. The means for adjusting the polar directivity may further include an adjustable amplifier coupled to the second microphone system.

In one embodiment, the first inlet opening and the second inlet opening are relatively close together. In one particular embodiment, the first inlet opening and second inlet opening are less than one/half inch apart, and the first inlet opening and the second inlet opening are located in approximately the same plane, which is generally horizontal to the ground when the in-the-ear hearing aid is located in a wearer's ear.

In another embodiment, the present invention includes a microphone system for use with an in-the-ear hearing aid. The system includes a first non-directional microphone system having a first inlet opening for receiving sound and having a first output signal representative of the sound received. A second non-directional microphone system is included having a second inlet opening for receiving sound having a second output signal representative of the sound received. Means are provided for coupling the first non-directional microphone system to the second non-directional microphone system for switching the in-the-ear hearing aid between a non-directional mode and a directional mode.

The means for coupling may be a switch having a closed position and an open position, and wherein when the switch is in the open position, the in-the-ear hearing aid is in the non-directional mode, and when the switch is in a closed position, the in-the-ear hearing aid is in a directional mode.

The second non-directional microphone system may further include means for inverting the second output signal. The second non-directional microphone system may further include means for adjusting the phase delay of the second output signal relative to the first output signal. The means for adjusting the phase delay may include a low pass filter having an adjustable capacitor. Further, the second non-directional microphone system may further include means for adjusting the amplitude of the second output signal relative to the first output signal.

The present invention may include means for summing the first output signal and the second output signal. The means for summing may have an output coupled to an amplifier. The amplifier may include a phase delay.

In yet another embodiment, the present invention may integrate two switched directional/non-directional microphone systems as described above into a two instrument, in-the-ear CROS or BiCROS hearing aid. The connection between the two instruments of the CROS or BiCROS hearing aid may be made via a hard wire connection, RF, or induction transmission.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 3:
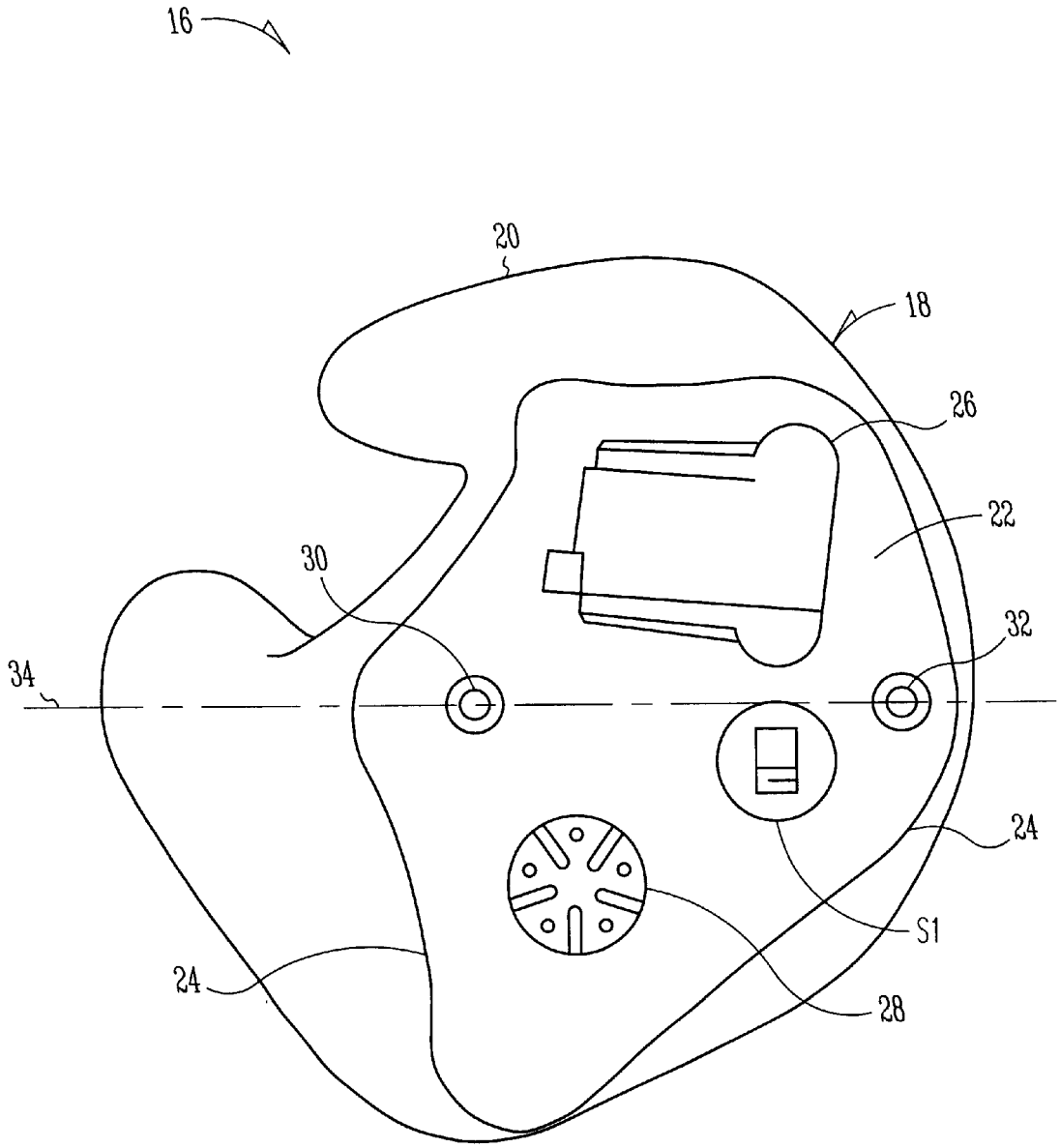
FIG. 3 is a perspective view of an in-the-ear hearing aid in accordance with the present invention.

In FIG. 3, an in-the-ear hearing aid is generally shown at 16. The in-the-ear (ITE) hearing aid 16 includes a housing 18 having a face plate 22 and a molded shell 20. The molded shell 20 is adhered to the face plate 22, indicated along line 24. The molded shell 20 is custom molded to fit each individual hearing aid wearer by known processes, such as making an impression of the individual hearing aid wearer's ear and forming the molded shell based on that impression. The face plate 22 is coupled to a circuit board (not shown) located inside the ITE hearing aid 16, which contains the circuitry for the hearing aid device.

Extending through the in-the-ear hearing aid 16 and specifically face plate 22, is a battery door 26, a volume control 28, a switch S1, a microphone mic F, and a microphone mic B. The battery door 26 allows the hearing aid wearer access to the in-the-ear hearing aid 16 for changing the battery (not shown). The volume control 28 allows the hearing aid wearer to adjust the volume or amplification level of the hearing aid 16.

Switch S1 extends through the housing 18 and specifically face plate 22. Switch S1 allows the hearing aid wearer to manually switch the in-the-ear hearing aid 16 between a non-directional or directional hearing aid mode. Switch S1 is electronically coupled to the circuit contained within the in-the-ear hearing aid 16, which will be described in further detail later in the specification. With the novel idea of switch S1, a hearing aid wearer can switch to a non-directional hearing aid mode to hear sounds from all directions, or a directional hearing aid mode, such as for reducing background noise when carrying on a conversation in a crowded room.

Microphone mic F and microphone mic B include inlet tubes 30, 32 which protrude through the in-the-ear hearing aid face plate 22. Microphone mic F and microphone mic B are spaced a relatively short distance apart, preferably less than ½ inch. In one preferred embodiment, microphone mic F and microphone mic B are preferably ⅓ of an inch apart.

The axis of directionality is defined by a line drawn through the inlet tube 30 and inlet tube 32 in face plate 22, indicated at 34. The in-the-ear hearing aid 16 in accordance with the present invention is of a molded design such that the axis of directionality 34 is relatively horizontal to the floor when the in-the-ear hearing aid 16 is positioned within the hearing aid 16 wearer's ear. With this design, optimum directional performance of the in-the- ear hearing aid 16 is achieved.

Figure 4:
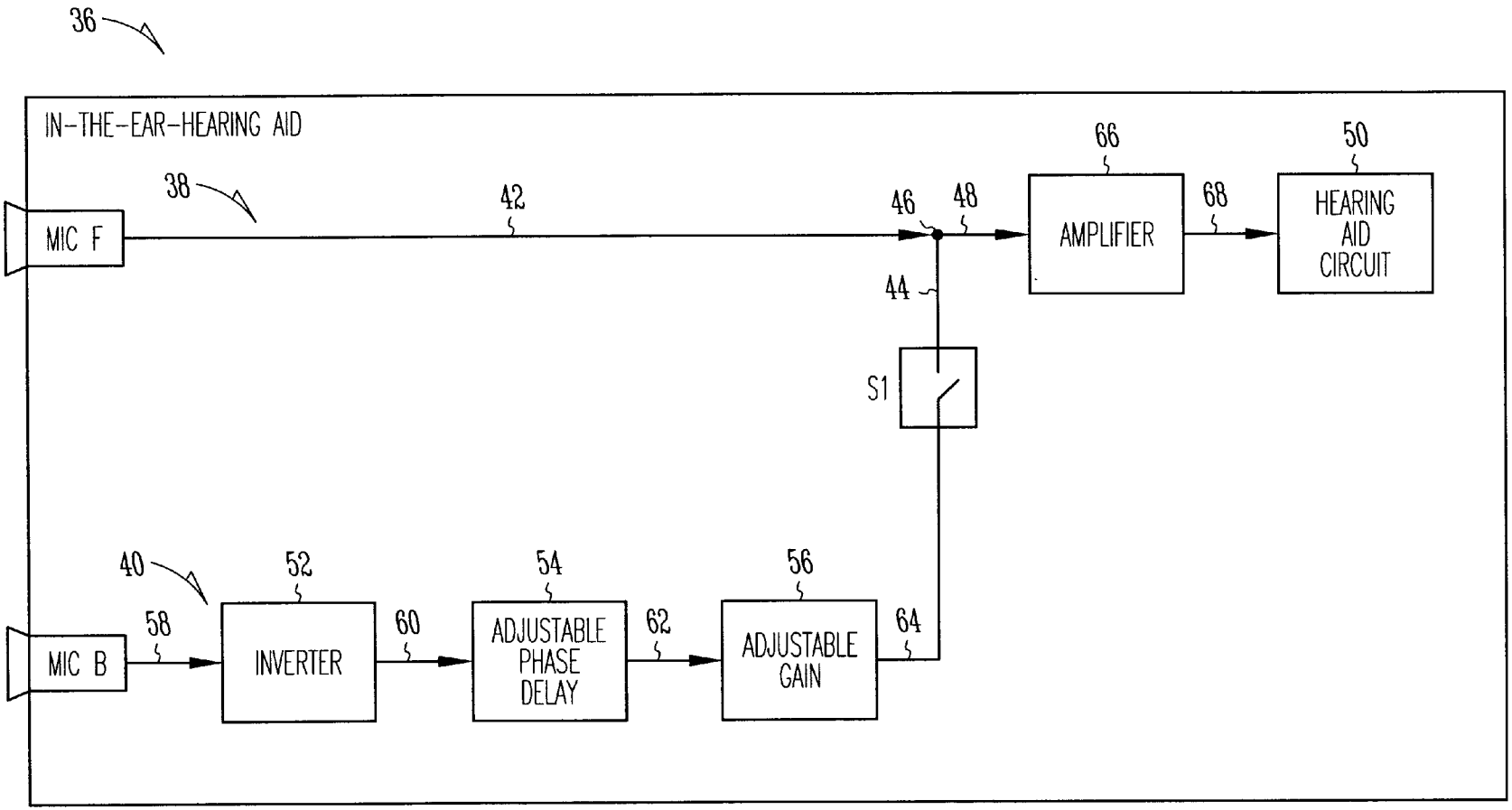
FIG. 4 is a system block diagram of one embodiment of the hearing aid in accordance with the present invention.

Referring to FIG. 4, a block diagram showing the directional microphone system in accordance with the present invention, for use with an in-the-ear hearing aid is generally shown at 36. The directional microphone system 36 utilizes two non-directional microphone circuits to achieve a directional microphone signal. The directional microphone system 36 includes a first non-directional microphone system 38 and a second non-directional microphone system 40. The output signals from the second non-directional microphone system 40 (indicated by signal 44) may be electrically coupled through switch S1, and summed at node 46 with the first non-directional microphone system 38 (indicated by signal 42). The resulting output signal is indicated at 48. The output signal 48 is electrically coupled to a hearing aid circuit 50. For example, the hearing aid circuit 50 may be a linear circuit, a compression circuit, an adaptive high-pass filter, and may include a high-power output stage.

The in-the-ear hearing aid 16 may be switched between a non-directional mode and a directional mode through the operation of switch S1. In the non-directional mode switch S1 is open (as shown), and non-directional microphone mic F feeds directly into hearing aid circuit 50. For operation in a directional mode, switch S1 is closed, and the first non-directional microphone system 38 and second non-directional microphone system 40 output signals 42 and 44 are summed at summing node 46, with the resulting output signal 48 being coupled to hearing aid circuit 50.

In one embodiment, the second non-directional microphone system 40 includes non-directional microphone mic B, an inverter 52, an adjustable pulse delay 54, and an adjustable gain 56. The output signal of microphone mic B is coupled to inverter 52, indicated at 58. The output signal of inverter 52 is coupled to the adjustable pulse delay 54, indicated at 60. The output of adjustable phase delay 54 is coupled to the adjustable gain 56, indicated at 62. The output of the adjustable gain 56 is coupled to switch S1, indicated at 64.

The output signal 58 of microphone mic B is inverted by inverter 52. Further, when switch S1 is closed, the phase delay 54 of the output of mic B may be adjusted relative to the output of microphone mic F. Similarly, adjustable gain 56 adjusts the amplitude of the output signal received from mic B relative to the output signal 42 from microphone mic F. By providing such adjustment, the hearing aid manufacturer and/or the hearing aid dispenser may vary the polar directivity pattern of the in-the-ear hearing aid. The adjustable non-directional microphone system 40 allows the polar pattern to be adjusted to compensate for small ears which do not allow larger inlet spacing. Further, the adjustable non-directional microphone system 40 allows for adjustments to compensate for the differences in manufacturing tolerances between non-directional microphone mic F and non-directional microphone mic B.

The output signal 48 from first non-directional microphone system 38 and second non-directional microphone system 40 may be amplified by passing it through an amplifier 66. The resulting output signal of amplifier 66, indicated at 68, is coupled to the hearing aid circuit 50.

Figure 5:
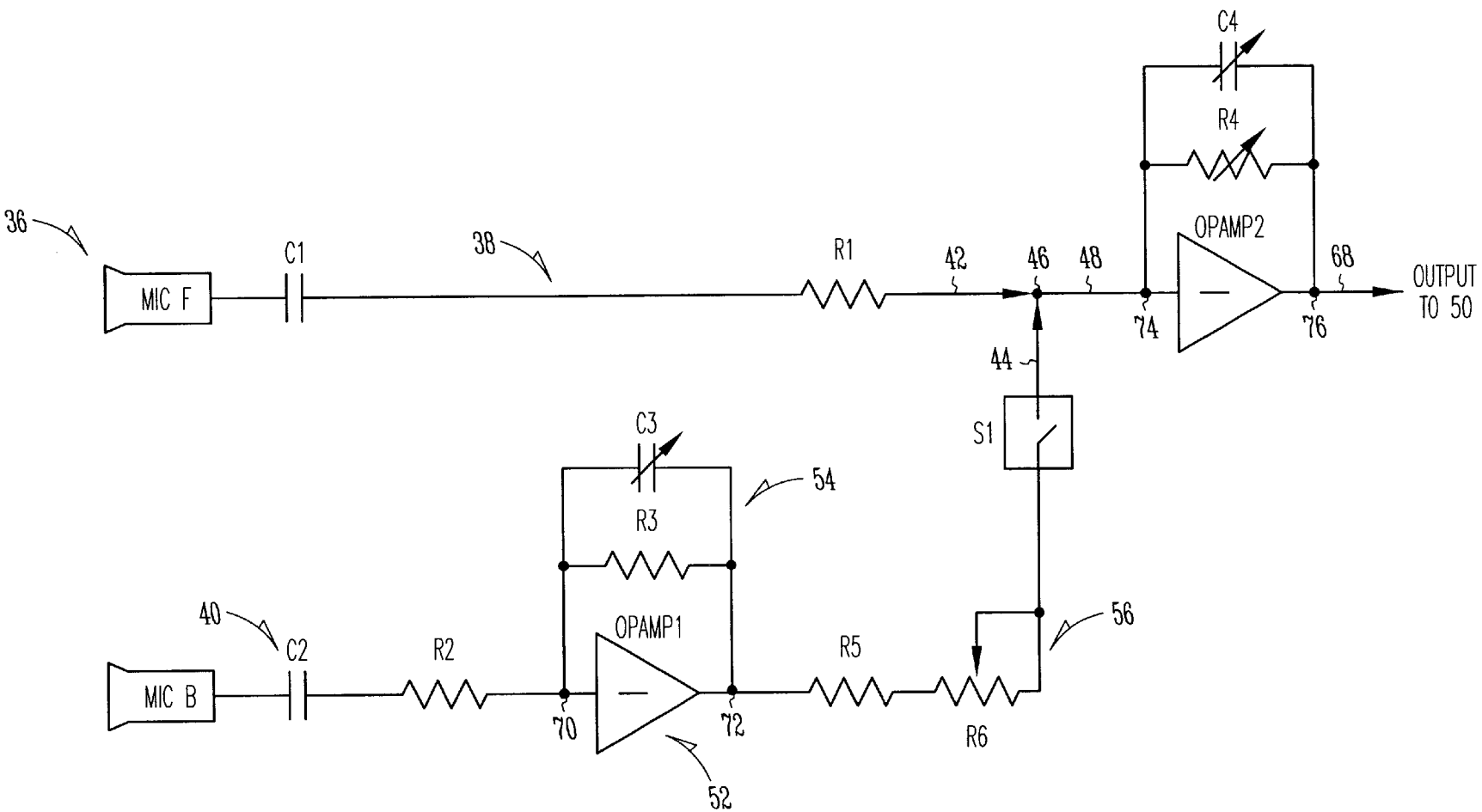
FIG. 5 is a schematic circuit diagram of one embodiment of the in-the-ear hearing aid in accordance with the present invention.

Referring to FIG. 5, a schematic diagram of one preferred embodiment of the-in-ear hearing aid directional microphone system 36 is shown. Non-directional microphone mic F has a coupling capacitor C1 coupled to its output. Resistor R1 is electrically coupled between coupling capacitor C1 and summing node 46. Non-directional microphone mic B has a coupling capacitor C2 coupled to its output. Coupled to the output of C2 is inverter 52 with adjustable phase delay 54. The adjustable phase delay is an adjustable low pass filter. The inverter 52 is an operational amplifier OPAMP 1, shown in an inverting configuration. Coupled between capacitor C2 and the input node 70 of OPAMP 1 is resistor R2. Coupled between OPAMP 1 input node 70 and an OPAMP 1 output node 72 is resistor R3. Similarly, coupled between OPAMP 1 input node 70 and OPAMP 1 output node 72 is a capacitor C3.

As previously described herein, OPAMP 1 inverts the output signal received from non-directional microphone mic B. As such, when the output signal 42 and output signal 44 are summed at summing node 46, the signals are subtracted, resulting in output signal 48.

The gain between the input of OPAMP 1 and the output of OPAMP 1 is indicated by the relationship R3/R2. In one preferred embodiment, R3 equals R2, resulting in a unity gain output signal from OPAMP 1.

The phase delay 54 low pass capacitor C3 may be adjustable. By adjusting capacitor C3, and/or resistor R3, the phase delay of the non-directional microphone mic B output relative to the non-directional microphone mic F may be adjusted. Coupled to the output node 72 of OPAMP 1 is a resistor R5 in series with an adjustable resistor or potentiometer R6. Further, coupled to output signal 48 is an inverting operational amplifier, OPAMP 2 having an input node 74 and an output node 76. Coupled between the input node 74 and the output node 76 is resistor R4. Also coupled between the input node 74 and the output node 76 is a capacitor C4. It is recognized that capacitor C4 and resistor R3 and R4 may also be adjustable.

Figure 1:
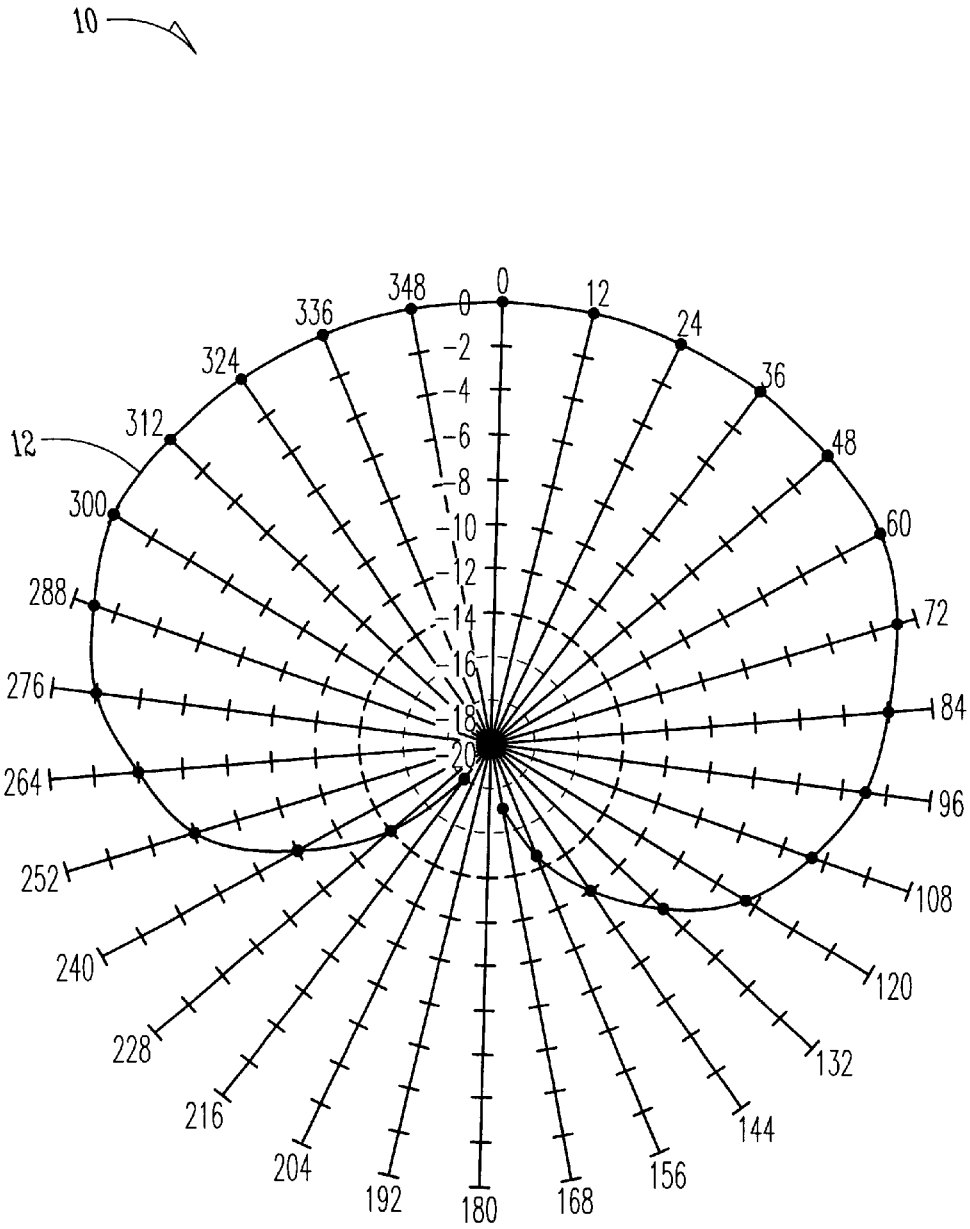
FIG. 1 is a cardioid polar directivity pattern of an in-the-ear hearing aid.
Figure 2:
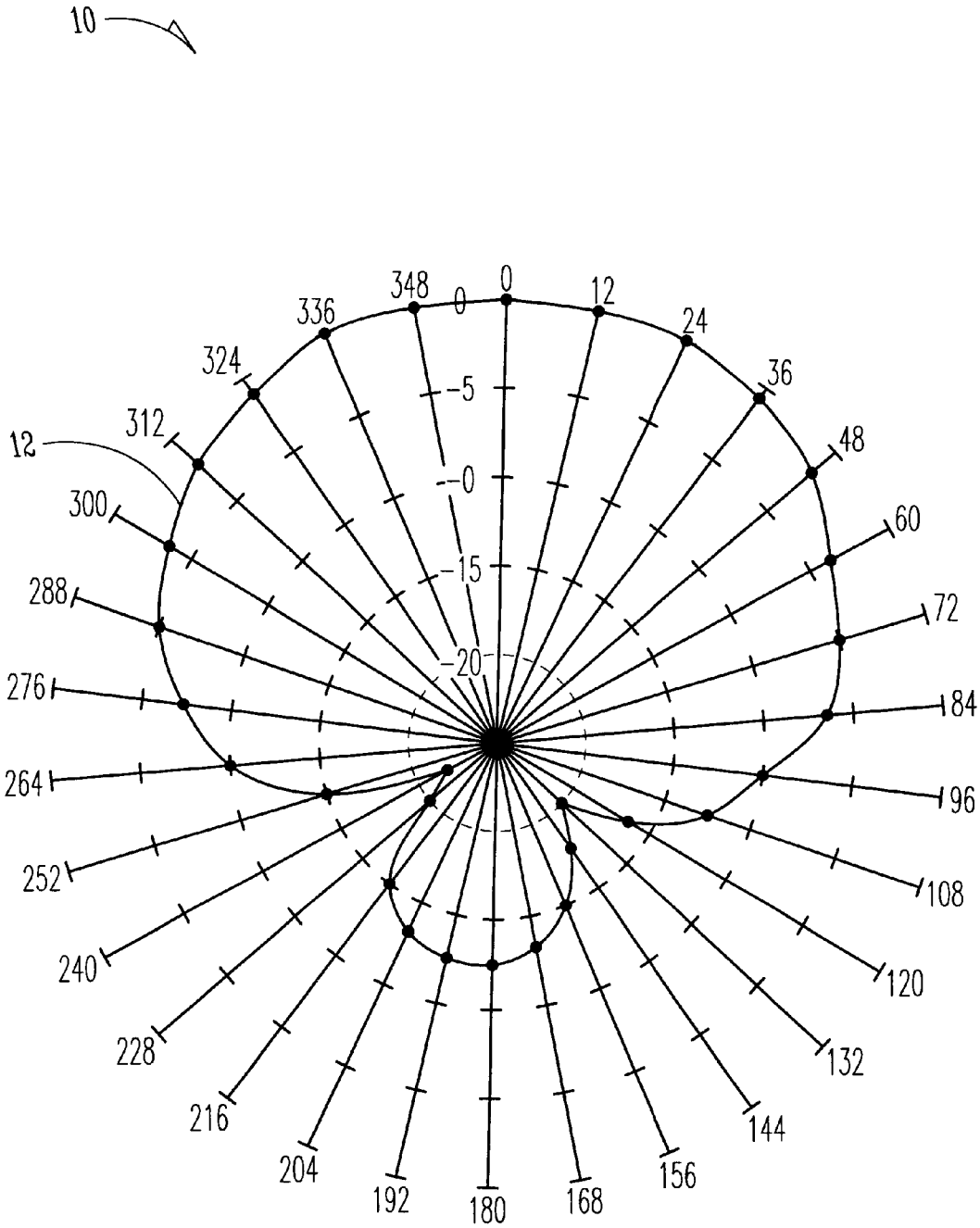
FIG. 2 is a super cardioid polar directivity pattern of an in-the-ear hearing aid.

When switch S1 is open, the resulting amplification or gain from the output from non-directional microphone mic F is the ratio of resistors R4/R1. When switch S1 is closed, the output gain contribution from mic B is determined by the ratio of R4/(R5 plus R6). By adjusting the adjustable potentiometer R6, the amplitude of non-directional microphone mic B of the output signal relative to the output signal amplitude of non-directional microphone mic F may be adjusted. As previously stated herein, by adjusting both capacitor C3 and resistor R6, the hearing aid may be adjusted to vary the polar directivity pattern of the in-the-ear hearing aid from cardioid (FIG. 1) to super cardioid (FIG. 2), as desired.

In one preferred embodiment, the values for the circuit components shown in FIG. 5 are as follows:

TABLE 1

| | | |
|---|---|---|
| C1 | = | .01 uF |
| C2 | = | .01 uF |
| C3 | = | .0022 uF |
| C4 | = | 110 pF |
| R1 | = | 10K |
| R2 | = | 10K |
| R3 | = | 10K |
| R4 | = | 1M |
| R5 | = | 10K |
| R6 | = | 2.2K |

Non-directional microphone mic F and non-directional microphone mic B can be non-directional microphones as produced by Knowles No. EM5346. Operational amplifiers OPAMP 1 and OPAMP 2 may be inverting Gennum Hearing Aid Amplifiers No. 1/4 LX509.

The hearing aid in accordance with the present invention allows a person wearing an in-the-ear hearing aid to switch between a non-directional mode and a directional mode by simple operation of switch S1 located on the in-the-ear hearing aid 16. The circuit components which makeup the directional microphone system 36 and the hearing aid circuit 50 are all located within the hearing aid housing 18 and coupled to the inside of face plate 22. Further, by adjustment of the adjustable phase delay 54 and adjustable gain 56, the directional microphone system 36 may be adjusted to vary the polar directivity pattern to account for manufacturing differences. It may be desirable to adjust the polar directivity pattern between cardioid and super cardioid for various reasons, such as to compensate for limited inlet spacing due to small ears or to compensate for the manufacturing tolerances between non-directional microphone mic F and non-directional microphone mic B. It is also recognized that capacitor C4 and resistor R4 may be adjustable to compensate for each individual's hearing loss situation.

With the novel design of the present invention, the associated circuitry of the present invention allows the two non-directional microphones mic B and mic F to be positioned very close together and still produce a directional microphone system having a super cardioid polar directivity pattern. Further, the directional microphone system in accordance with the present invention is able to space the two microphones less than one inch apart, and in a preferred embodiment, ⅓ of an inch apart in order for the directional microphone system in accordance with the present invention to be incorporated into an in-the-ear hearing aid device. The in-the-ear hearing aid 16 circuitry, including the directional microphone system 36 circuitry and the hearing aid circuit 50 circuitry, utilize microcomponents and may further utilize printed circuit board technology to allow the directional microphone system 36 and hearing aid circuit 50 to be located within a single in-the-ear hearing aid 16.

Figure 6:
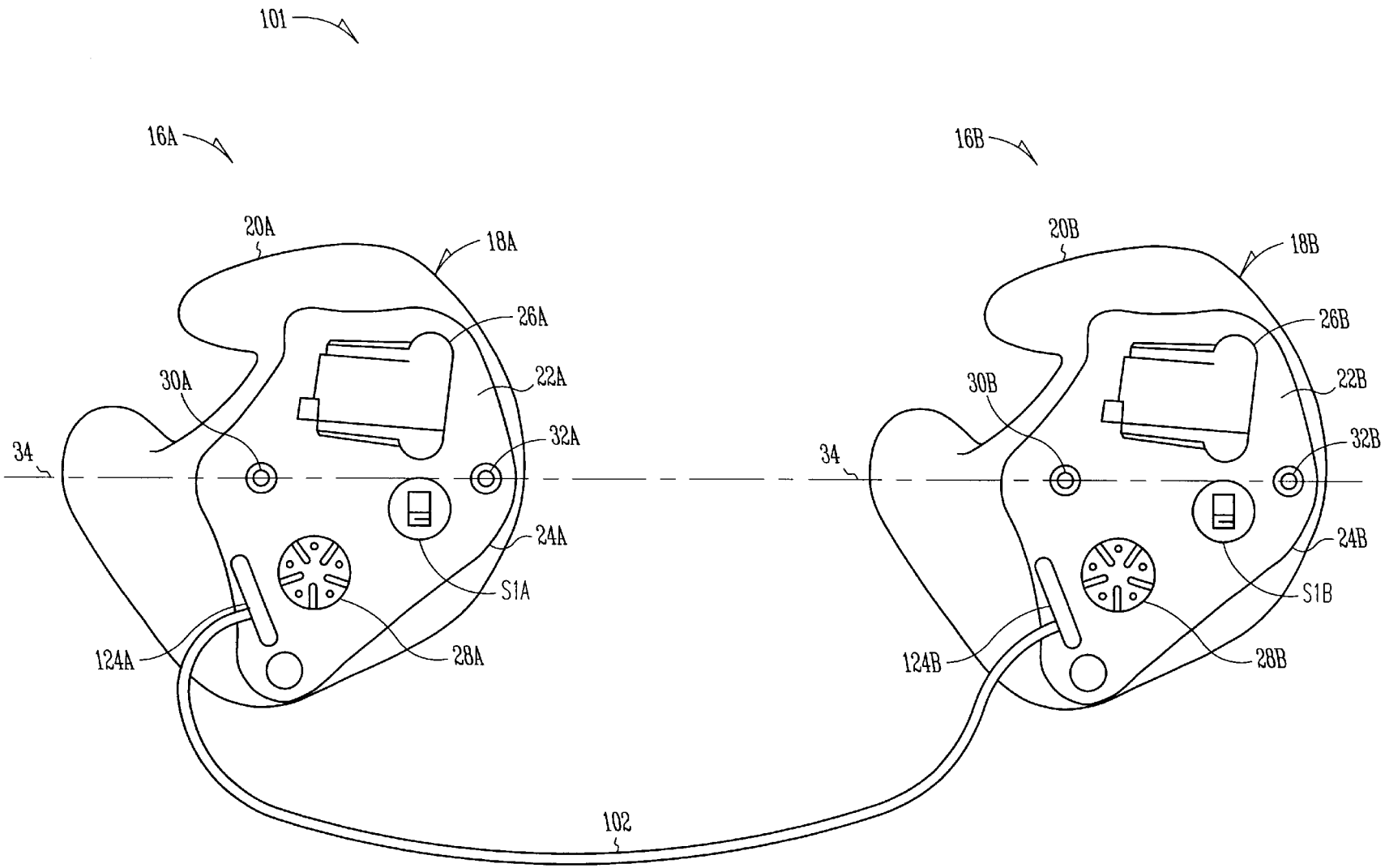
FIG. 6 is a pictorial drawing of a two instrument BiCROS hearing aid with a wire connecting the two units.

In FIG. 6, a BiCROS, in-the-ear (ITE) hearing aid system is generally shown at 101. CROS and BiCROS systems are designed for individuals with little or no hearing in one ear and some hearing capability in the other ear. CROS/BiCROS systems take sound from the bad ear and send it, via hard wire (illustrated), RF (not illustrated), or induction transmission (not illustrated, but as in the Telex Wireless CROS system) to a receiver in the other ear. The BiCROS, ITE hearing aid 101 of FIG. 6 includes two separate instruments 16A and 16B (each to be placed in an ear of the individual) and a wire cord 102 interconnecting the two instruments 16A and 16B at wire cord junctions 124A and 124B. One of the instruments 16A will function as a transmitter unit and will be placed in the unaidable ear of the individual. The other instrument 16B will function as a receiver and will be placed in the better ear of the individual. However, since both instruments 16A and 16B have the dual microphone system, each instrument 16A and 16B can be designated as either a transmitter or a receiver in the device configuration.

An in-the-ear CROS system (not-illustrated) will operate in a manner similar to the illustrated BiCROS system shown in FIG. 6, except that CROS systems are generally utilized for individuals with one unaidable ear and one ear with a normal hearing or a mild hearing loss. Thus, in a CROS system, a microphone set is worn only in the unaidable ear, and the receiver is worn in/on the better ear, while in the illustrated BiCROS system 101, a microphone set is worn in/on both ears, and the receiver is worn on the better ear.

Each instrument 16A and 16B has a molded shell 20A, 20B which is custom molded to fit each individual hearing aid wearer by known processes, such as making an impression of the individual hearing aid wearer's ear and forming the molded shell based on that impression. Each instrument 16A and 16B also has a face plate 22A, 22B coupled to a circuit board (not shown) located inside the instrument 16A and 16B.

Extending through each instrument 16A and 16B and specifically face plate 22A, 22B, is a battery door 26A, 26B, a volume control 28A, 28B, a switch S1A, S1B, a microphone mic FA, FB, and a microphone mic BA, BB. The battery door 26A, 26B allows the hearing aid wearer access to the instrument 16A or 16B for changing the battery (not shown). The volume control 28A, 28B allows the hearing aid wearer to adjust the volume or amplification of the instrument 16A or 16B.

Switch S1A, S1B extends through the face plate 22A, 22B, and allows the hearing aid wearer to manually switch the instrument 16A and 16B between a non-directional or directional hearing aid mode. Switch S1A, S1B is electronically coupled to the circuit contained within the instrument 16A or 16B. With the novel idea of switch S1A, S1B, a hearing aid wearer can switch to a non-directional hearing aid mode to hear sounds from all directions, or a directional hearing aid mode, such as for reducing background noise when carrying on a conversation in a crowded room.

Microphone mic FA, FB and microphone mic BA, BB in instrument 16A and 16B include inlet tubes 30A, 30B and 32A, 32B which protrude through the instrument face plate 22A, 22B. Microphone pairs mic FA and BA in instrument 16A and microphone mic FB and BB in instrument 16B are spaced a relatively short distance apart, preferably less than ½ inch. In one preferred embodiment, microphone pair mic FA and BA in instrument 16A and microphone pair mic FB and BB in instrument 16B are preferably ⅓ of an inch apart.

An axis of directionality is defined by a line drawn through the inlet tube 30A, 30B and inlet tube 32A, 32B in face plate 22A, 22B, indicated at 34. The instrument 16A and 16B in accordance with the present invention is of a molded design such that the axis of directionality 34 is relatively horizontal to the floor when the instrument is positioned within the hearing aid wearer's ear. With this design, optimum performance of the hearing aid system is achieved.

The combination of a switched directional/non-directional microphone system in a custom in-the-ear CROS or BiCROS hearing aid system as illustrated in FIG. 6 will result in a significant improvement in signal to noise ratio for individuals in noisy listening situations.

Figure 7:
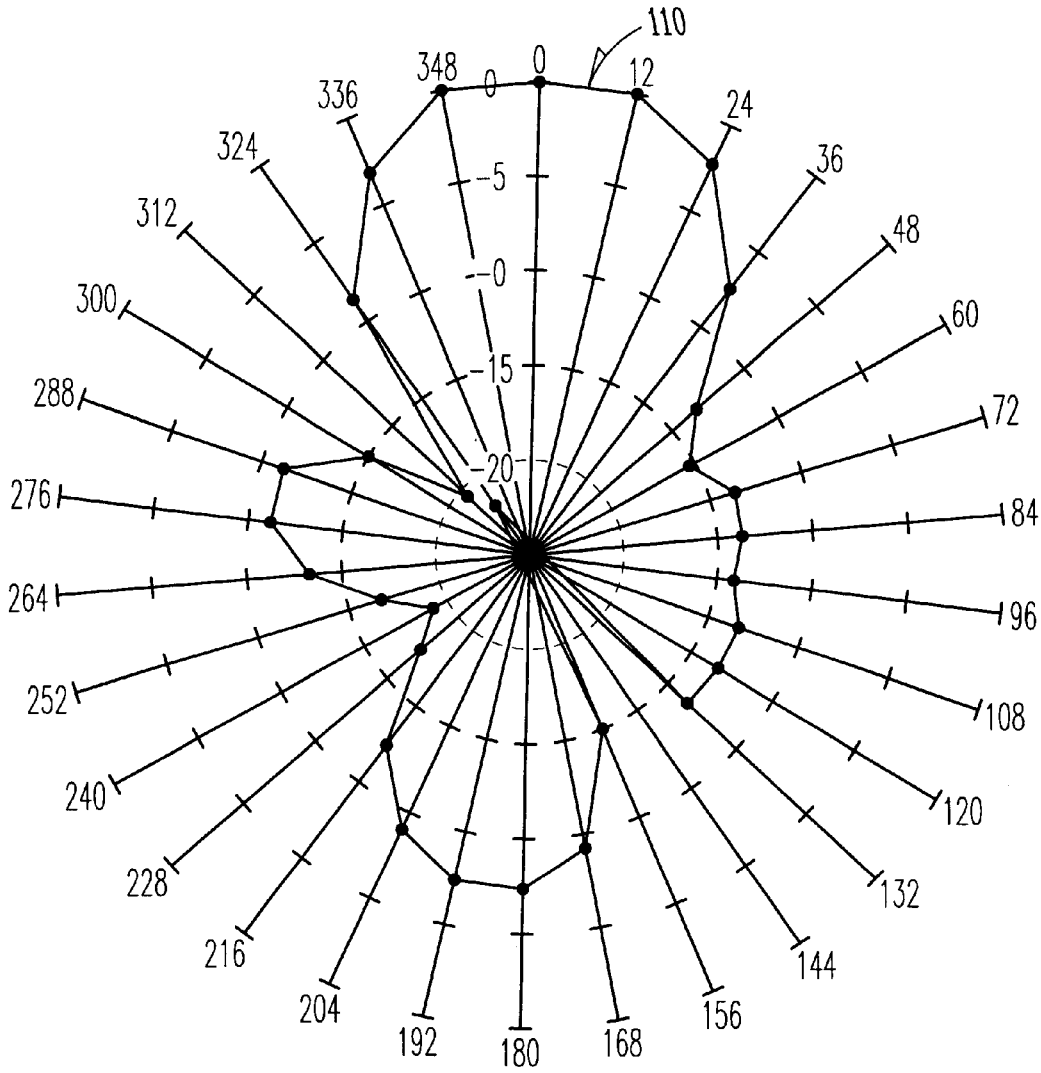
FIG. 7 is a graphical embodiment of the polar directivity pattern of a two instrument BiCROS hearing aid with both instruments switched into directional mode.

Referring now to FIG. 7, a polar directivity pattern 110 is shown for a BiCROS hearing aid system, with both instruments 16A and 16B switched into directional mode. The pattern was obtained on an HA-1 2 cc coupler in an anechoic chamber. The polar directivity pattern 110 shows the amount of pickup at a specific frequency (in this case, 1K) of a BiCROS directional hearing aid system as a function of azimuth angle of sound incidence. In the illustrated pattern, the Directivity Index (DI—the ratio of sounds incident straight ahead to those incident all around an imaginary sphere) was 10.1 dB and the Unidirectional Index (UDI—the ratio of sounds incident on an imaginary front hemisphere to those from an imaginary rear hemisphere) was 5.0 dB. This polar pattern 110 indicates that sounds incident from the sides and rear will be significantly attenuated. The DI predicts up to a 10 dB improvement in signal-to-noise ratio, depending upon the amount of reverberation in the listening environment.

Figure 8:
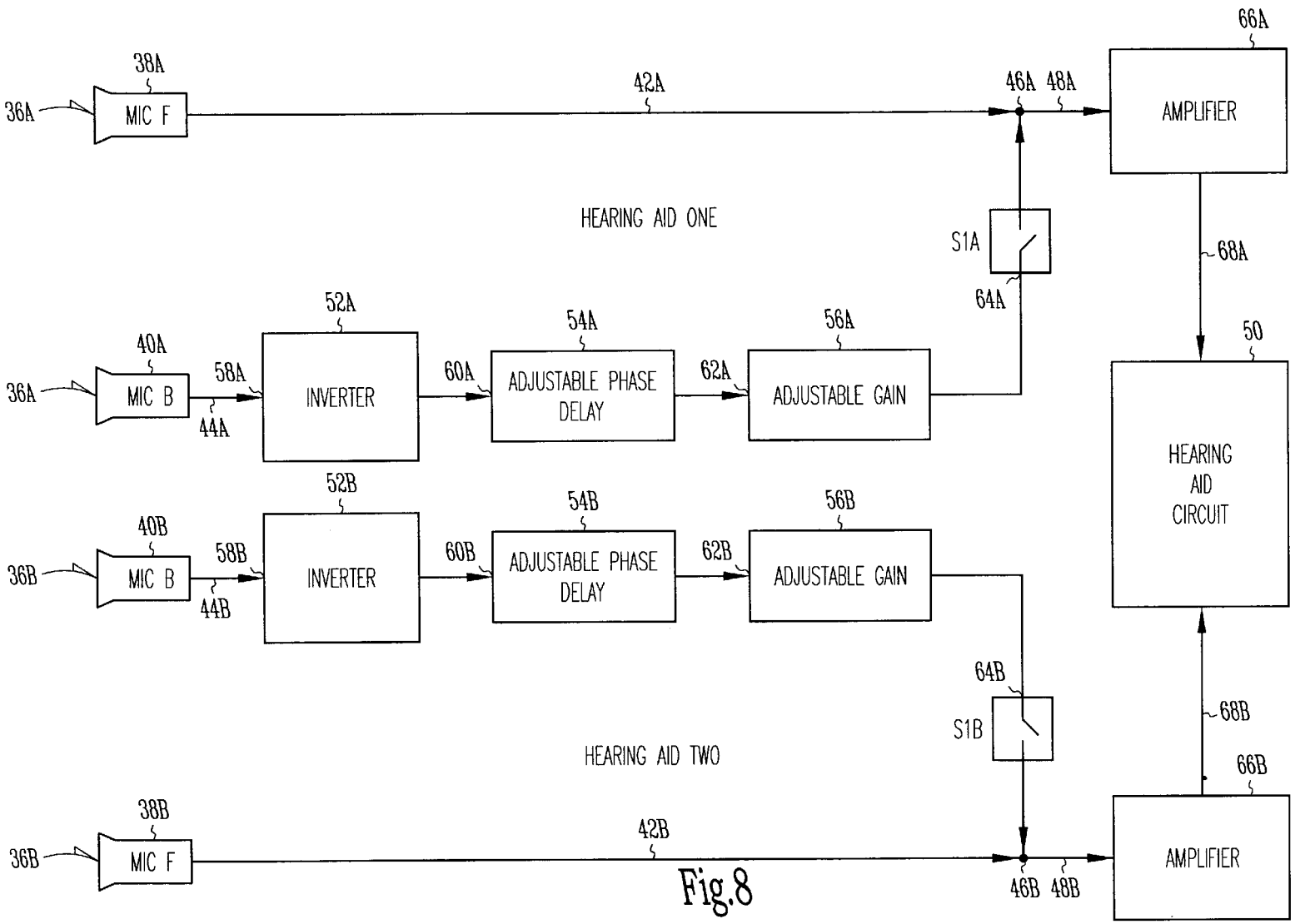
FIG. 8 is a system block diagram of an embodiment of a BiCROS in-the ear hearing aid having a switched directional/non-directional capability.

Referring to FIG. 8, a block diagram showing the BICROS, in-the-ear directional hearing aid system in accordance with the present invention is illustrated. In this embodiment, each of the two instruments of the hearing aid has its own microphone system. The directional microphone system 36A, 36B within each of the two instruments utilizes two non-directional microphone circuits 38A, 40A and 38B, 40B to achieve a directional microphone signal. Each directional microphone system 36A, 36B includes a first non-directional microphone system 38A, 38B and a second non-directional microphone system 40A, 40B. The output signals from the second non-directional microphone system 40A, 40B (indicated by signal 42A, 42B) may be electrically coupled through switch S1A and S1B, and summed at node 46A, 46B with the first non-directional microphone system 38A, 38B (indicated by signal 44A, 44B). The resulting output signal from each of the instruments is indicated at 48A, 48B. The output signal 48A, 48B from each of the instruments is coupled to a hearing aid circuit 50. For example, the hearing aid circuit may be a linear circuit, a compression circuit, an adaptive high-pass filter, and may include a high-power output stage.

Each of the two instruments 16A and 16B may be switched between a non-directional mode and a directional mode through the operation of switch S1A, S1B. In the non-directional mode, switch S1A, S1B is open (as shown), and non-directional microphone mic F 38A, 38B feeds directly into hearing aid circuit 50. For operation in a directional mode, switch S1A, S1B is closed, and the first non-directional microphone system 38A, 38B and second non-directional microphone system 40A, 40B output signals are summed at summing node 46A, 46B, with the resulting output signal 48A, 48B being coupled to hearing aid circuit.

In one embodiment, the second non-directional microphone system 40A, 40B of each instrument 16A and 16B includes non-directional microphone mic B, an inverter 52A, 52B, an adjustable phase delay 54A, 54B, and an adjustable gain 56A, 5B. The output signal of microphone mic B is coupled to inverter 52A, 52B, indicated at 58A, 58B. The output signal of inverter 52A, 52B is coupled to the adjustable phase delay 54A, 54B, indicated at 60A, 60B. The output of the adjustable phase delay 54A, 54B is coupled to the adjustable gain 56A, 56B, indicated at 62A, 62B. The output of the adjustable gain 56A, 56B is coupled to switch S1A, S1B, indicated at 64A, 64B.

The output signal of microphone mic B in each of the instruments 58A, 58B is inverted by inverter 52A, 52B. Further, the adjustable phase delay 54A, 54B may adjust the phase delay of the output of mic B relative to the output of microphone mic F in each of the instruments. Similarly, adjustable gain 56A, 56B adjusts the amplitude of the output signal received from mic B relative to the output signal from microphone mic F. By providing such an adjustment, the hearing aid manufacturer may vary the polar directivity pattern of each instrument.

The output signal 48A, 48B from first non-directional microphone system 38A, 38B and second non-directional microphone system 40A, 40B in each of the instruments may be amplified by passing it through amplifier 66A, 66B. The resulting output signal of amplifier 68A, 68B in each of the instruments 16A and 16B, is coupled to the hearing aid circuit 50.

As mentioned above, in a CROS system (not illustrated), the instrument in the better ear will not contain the microphone mic B or the microphone mic F, as shown in the illustrated BiCROS system.

Figure 9:
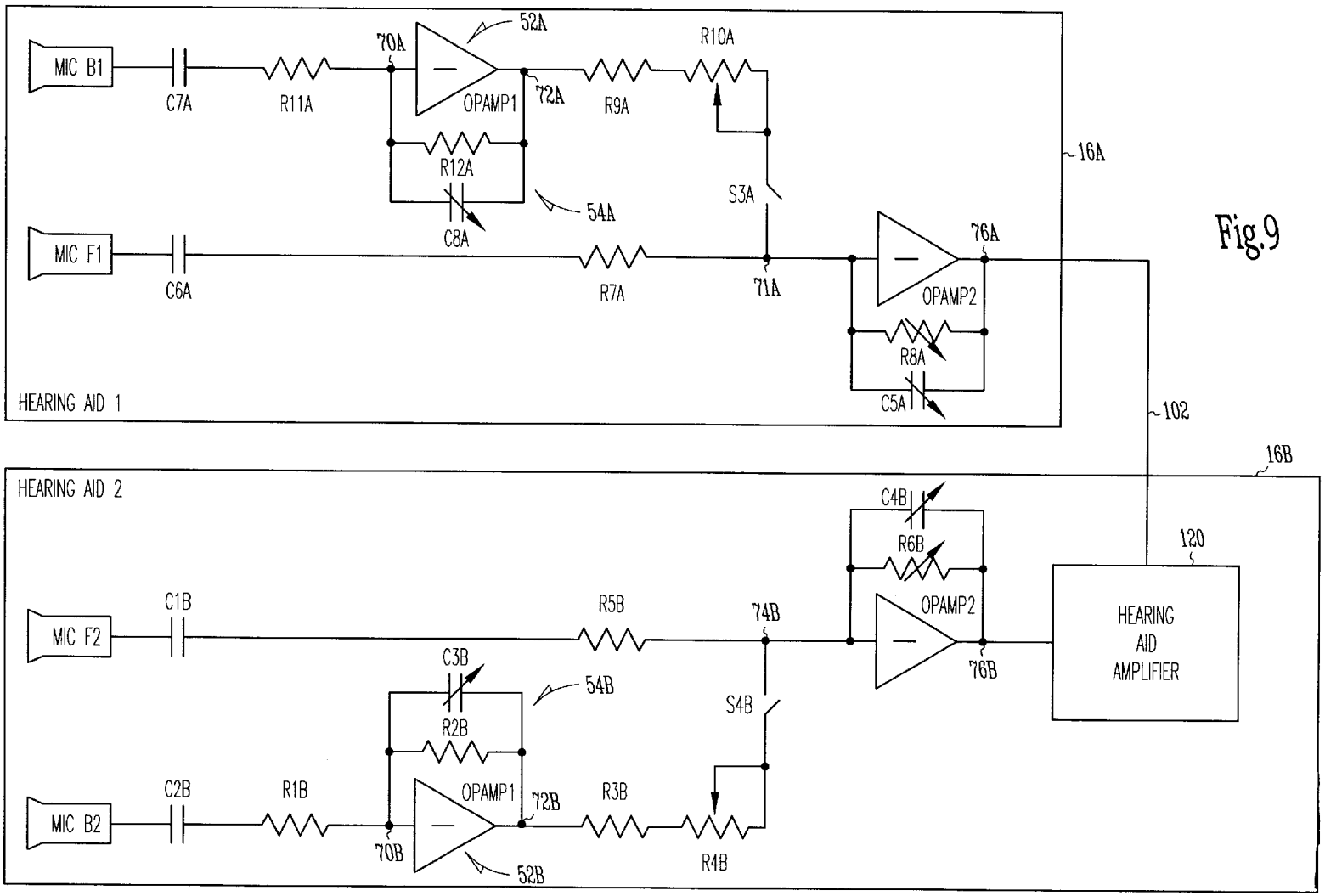
FIG. 9 is a schematic circuit diagram of an embodiment of a two instrument BiCROS hearing aid having switched directional/non-directional capabilities.

Referring to FIG. 9, a schematic diagram of one preferred embodiment of a BiCROS, in-the-ear hearing aid system with switched directional/non-directional microphone is shown. This hearing aid system has two instruments 16A and 16B. The first instrument 16A, is designed to be placed in the individual's unaidable ear. The second instrument 16B, having hearing aid amplifier 120, is designed to be placed in the individual's better ear. A connection 102 for transmitting a signal from the first instrument 16A to the second instrument 16B may be made in a variety of ways, including a hard wire (illustrated), a RF transmission from the first instrument to the second instrument (not illustrated), or an induction transmission as in the Telex Wireless CROS system (not illustrated).

In the first instrument 16A, non-directional microphone mic F1 has a coupling capacitor C6A coupled to its output. Resistor R7A is electrically coupled between coupling capacitor C6A and node 74A. Non-directional microphone mic B1 has a coupling capacitor C7A coupled to its output. Coupled to the output of C7A is inverter 52A with adjustable phase delay 54A. The inverter 52A is an operational amplifier OPAMP 4, shown in an inverting configuration. Coupled between capacitor C7A and the input node 70A of OPAMP 4 is resistor R11A. Coupled between OPAMP 4 input node 70A and an OPAMP 4 output node 72A is resistor R12A. Similarly, coupled between OPAMP 4 input node 70A and OPAMP 4 output node 72A is capacitor C8A.

As previously described herein, OPAMP 4 inverts the output signal received from non-directional microphone mic B1. As such, when the output signal 42A and output signal 44A are summed at summing node 46A, the signals are subtracted, resulting in output signal 48A.

The gain between the input of OPAMP 4 and the output of OPAMP 4 is indicated by the relationship R12A/R11A. In one preferred embodiment, R12A equals R11A, resulting in a unity gain output signal from OPAMP 4.

The adjustable phase delay capacitor C8A may be adjustable. By adjusting capacitor C8A, the phase delay of the non-directional microphone mic B1 output relative to the non-directional microphone mic F1 may be adjusted. Coupled to the output node 72A of OPAMP 4 is a resistor R9A in series with an adjustable resistor or potentiometer R10A. Further, coupled to output signal 72A is an inverting operational amplifier, OPAMP 3 having an input node 74A and an output node 76A. Coupled between the input node 74A and the output node 76A is a resistor R8A. Also coupled between the input node 74A and the output node 76A is a capacitor C5A. It is recognized that capacitor C5A and resistor R8A may also be adjustable.

When switch S3A is open, the resulting amplification or gain from the output from non-directional microphone mic F1 is the ratio of resistors R8A/R7A. When switch S3A is closed, the output gain contribution from mic B1 is determined by the ratio of R8A/(R7A plus R10A). By adjusting the adjustable potentiometer R10A, the amplitude of non-directional microphone mic B1 of the output signal relative to the output signal amplitude of non-directional microphone mic F1 may be adjusted. As previously stated herein, by adjusting both capacitor C8A and resistor R10A, the hearing aid may be adjusted to vary the polar directivity pattern of the in-the-ear hearing aid to account for component tolerances.

In one known embodiment, the values for the circuit components shown in FIG. 9 are as follows:

TABLE 2

| | | |
|---|---|---|
| C6A | = | .01 uF |
| C7A | = | .01 uF |
| C8A | = | .0022 uF |
| C5A | = | 110 pF |
| R7A | = | 10K |
| R11A | = | 10K |
| R12A | = | 10K |
| R8A | = | 1M |
| R9A | = | 10K |
| R10A | = | 2.2K |

Non-directional microphone mic F1 and non-directional mic B1 can be non-directional microphones as produced by Knowles No. EM5346. Operational amplifiers OPAMP 3 and OPAMP 4 may be inverting Gennum Hearing Aid Amplifiers No. 1/4 LX509.

In the second instrument 16B, non-directional microphone mic F2 has a coupling capacitor C1B coupled to its output. Resistor R5B is electrically coupled between coupling capacitor C1B and node 74B. Non-directional microphone mic B2 has a coupling capacitor C2B coupled to its output. Coupled to the output of C2B is inverter 52B with adjustable phase delay 54B. The inverter 52B is an operational amplifier OPAMP 1, shown in an inverting configuration. Coupled between capacitor C2B and the input node 70B of OPAMP 1 is resistor R1B. Coupled between OPAMP 1 input node 70B and an OPAMP 1 output node 72B is resistor R2B. Similarly, coupled between OPAMP 1 input node 70B and OPAMP 1 output node 72B is capacitor C3B.

As previously described herein, OPAMP 1 inverts the output signal received from non-directional microphone mic B2. As such, when the output signal 42B and output signal 44B are summed at summing node 46B, the signals are subtracted, resulting in output signal 48B.

The gain between the input of OPAMP 1 and the output of OPAMP 1 is indicated by the relationship R2B/R1B. In one preferred embodiment, R2B equals R1B, resulting in a unity gain output signal from OPAMP 1.

The adjustable phase delay capacitor C3B may be adjustable. By adjusting capacitor C3B, the phase delay of the non-directional microphone mic B2 output relative to the non-directional microphone mic F2 may be adjusted. Coupled to the output node 72B of OPAMP 1 is a resistor R3B in series with an adjustable resistor or potentiometer R4B. Further, coupled to output signal 72B is an inverting operational amplifier, OPAMP 2 having an input node 74B and an output node 76B. Coupled between the input node 74B and the output node 76B is a resistor R6B. Also coupled between the input node 74B and the output node 76B is a capacitor C4B. It is recognized that capacitor C4B and resistor R6B may also be adjustable.

When switch S4B is open, the resulting amplification or gain from the output from non-directional microphone mic F2 is the ratio of resistors R6B/R5B. When switch S4B is closed, the output gain contribution from mic B2 is determined by the ratio of R6B/(R3B plus R4B). By adjusting the adjustable potentiometer R4B, the amplitude of non directional microphone mic B2 of the output signal relative to the output signal amplitude of non-directional microphone mic F2 may be adjusted. As previously stated herein, by adjusting both capacitor C3B and resistor R4B, the hearing aid may be adjusted to vary the polar directivity pattern of the in-the-ear hearing aid to account for component tolerances.

In one known embodiment, the values for the circuit components shown in FIG. 9 are as follows:

TABLE 3

| | | |
|---|---|---|
| C1B | = | .01 uF |
| C2B | = | .01 uF |
| C3B | = | .0022 uF |
| C4B | = | 110 pF |
| R5B | = | 10K |
| R1B | = | 10K |
| R2B | = | 10K |
| R6B | = | 1M |
| R3B | = | 10K |
| R4B | = | 2.2K |

Non-directional microphone mic F2 and non-directional mic B2 can be non-directional microphones as produced by Knowles No. EM5346. Operational amplifiers OPAMP 1 and OPAMP 2 may be inverting Gennum Hearing Aid Amplifiers No. 1/4 LX509.

The hearing aid in accordance with the present invention allows a person wearing a BiCROS in-the-ear hearing aid to switch between a non-directional mode and a directional mode by simple operation of switch S3A in the first instrument 16A and switch S4A in a second instrument 16B. The circuit components which make up the directional microphone system are all located within the hearing aid housing and coupled to the inside of face plate. Further, by adjustment of the adjustable phase delay and adjustable gain, the directional microphone system may be adjusted to vary the polar directivity pattern to account for component tolerances. It is also recognized that capacitor C5A and resistor R8A in the first instrument 16A and capacitor C4B and resistor R6B in the second instrument 16B may be adjustable to compensate for each individual's hearing loss situation.

It will be understood that this disclosure is, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. An in-the-ear hearing aid system, comprising:

a first instrument and a second instrument, each of said instruments having a shell molded to custom fit a different one of a hearing aid wearer's ear, wherein said first instrument is placed in said wearer's worse hearing ear and said second instrument is placed in said wearer's better hearing ear, said first instrument further comprising:

a first non-directional microphone system having a first inlet opening in a face plate for receiving sound and having a first output signal representative of the sound received;

a second non-directional microphone system having a second inlet opening in said face plate for receiving sound and having a second output signal representative of the sound received;

switch means having an operator extending through the first instrument for switching said first instrument between a non-directional mode and a directional mode; and connecting means for transmitting a signal from said first instrument to said second instrument.

2. The hearing aid system of claim 1, wherein the switch has an open position and a closed position, and wherein when the switch is in the closed position, the first instrument operates in the directional mode.

3. The hearing aid system of claim 2, wherein when the switch is in the open position, the first instrument operates in the non-directional mode.

4. The hearing aid system of claim 2, further comprising means for summing, selectively coupled to the first non-directional microphone system and the second nondirectional microphone having a summed output signal representative of the sum of the first output signal and the second output signal.

5. The hearing aid system of claim 4, wherein when the first instrument is in the directional mode, a directional output signal has a polar directivity pattern representative of the summed output signal; and wherein the means for summing further comprises means for adjusting the polar directivity pattern of the summed output signal between a cardioid polar directivity pattern and a super cardioid polar directivity pattern.

6. The hearing aid system of claim 5, wherein the means for adjusting the polar directivity pattern includes:

an inverting amplifier coupled to the second microphone system; and an adjustable phase delay coupled to the inverting amplifier.

7. The hearing aid system of claim 6, wherein the adjustable phase delay includes an adjustable low pass filter having an adjustable capacitor.

8. The hearing aid system of claim 6, wherein the means for adjusting the polar directivity further includes an adjustable amplifier coupled to the second microphone system.

9. The hearing aid system of claim 8, wherein the adjustable amplifier includes an adjustable potentiometer.

10. The hearing aid system of claim 1, wherein the first inlet opening and second inlet opening are relatively close together.

11. The hearing aid system of claim 1, wherein the first inlet opening and second inlet opening are less than ½ inch apart.

12. The hearing aid system of claim 11, wherein the first inlet opening and second inlet opening are located in approximately the same plane which is generally horizontal to the ground when the in-the-ear hearing aid is located in a wearer's ear.

13. The hearing aid system of claim 1, wherein said connecting means further comprises a hard wired connection.

14. The hearing aid system of claim 1, wherein said connecting means further comprises a radio frequency (RF) transmission.

15. The hearing aid system of claim 1, wherein said connecting means further comprises an induction transmission.

16. Apparatus for use as a Bilateral Routing Of Signals (BiCROS) type in-the-ear hearing aid, the apparatus comprising:

a first instrument and a second instrument, each said instrument having a shell molded to custom fit a hearing aid wearer's ear, wherein said first instrument is placed in said wearer's worst hearing ear and said second instrument is placed in said wearer's better hearing ear, said first instrument and said second instrument each having:

a first non-directional microphone system having a first inlet opening in a face plate for receiving sound and having a first output signal representative of the sound received;

a second non-directional microphone system having a second inlet opening in said face plate for receiving sound and having a second output signal representative of the sound received;

switch means having an operator extending through the first instrument for switching said first instrument and said second instrument between a non-directional mode and a directional mode; and connecting means for transmitting a signal from said first instrument to said second instrument.

17. The apparatus of claim 16, wherein the switch has an open position and a closed position, and wherein when the switch is in the closed position, the in-the-ear hearing aid operates in a directional mode.

18. The apparatus of claim 17, wherein when the switch is in an open position, the hearing aid operates in a non-directional mode.

19. The apparatus of claim 17, further comprising means for summing, selectively coupled to the first non-directional microphone system and the second nondirectional microphone having a summed output signal representative of the sum of the first output signal and the second output signal.

20. The apparatus of claim 19, wherein when the hearing aid is in the directional mode, the output signal has a polar directivity pattern representative of the summed output signal; and wherein the means for summing further comprises means for adjusting the polar directivity pattern of the summed output signal to account for component tolerances.

21. The apparatus of claim 20, wherein the means for adjusting the polar directivity pattern includes:

an inverting amplifier coupled to the second microphone system; and an adjustable phase delay coupled to the inverting amplifier.

22. The apparatus of claim 21, wherein the adjustable phase delay includes an adjustable low pass filter having an adjustable capacitor.

23. The apparatus of claim 21, wherein the means for adjusting the polar directivity further includes an adjustable amplifier coupled to the second microphone system.

24. The apparatus of claim 23, wherein the adjustable amplifier includes an adjustable potentiometer.

25. The apparatus of claim 16, wherein the first inlet opening and second inlet opening are relatively close together.

26. The apparatus of claim 16, wherein the first inlet opening and second inlet opening are less than ½ inch apart.

27. The apparatus of claim 26, wherein the first inlet opening and second inlet opening are located in approximately the same plane which is generally horizontal to the ground when the in-the-ear hearing aid is located in a wearer's ear.

28. The apparatus of claim 16, wherein said connecting means further comprises a hard wired connection.

29. The apparatus of claim 16, wherein said connecting means further comprises a radio frequency (RF) transmission.

30. The apparatus of claim 16, wherein said connecting means further comprises an induction transmission.

31. A hearing aid system, comprising:

an in-the-ear, first instrument and a second instrument, the first instrument having a shell molded to custom fit a worse one of a hearing aid wearer's ears, the shell including a face plate, the second instrument is associated with a better one of the wearer's ears, the first instrument having a non-directional mode and a directional mode and including:

a first non-directional microphone system having a first inlet opening in the face plate for receiving sound and having a first output signal representative of the sound received;

a second non-directional microphone system having a second inlet opening in the face plate for receiving sound and having a second output signal representative of the sound received;

a switch connected to the first instrument for switching the first instrument between the non-directional mode and the directional mode; and the system further including a signal connector between the first instrument and the second instrument for transmitting a signal from the first instrument to the second instrument.

32. The system of claim 31, wherein the signal connector includes a transmitter in the first instrument, a receiver in the second instrument, and a signal path between the transmitter and the receiver.

33. The system of claim 32, wherein the signal connector includes a transmitter in the second instrument and a receiver in the first instrument, whereby the system provides Bilateral Routing Of Signals (BiCROS).

34. The system of claim 32, wherein the signal connector is a hard wire connection.

35. The system of claim 32, wherein the second instrument includes a shell molded to custom fit the better one of the hearing aid wearer's ears.

36. The system of claim 35, wherein the second instrument has a directional mode and a non-directional mode and includes:

a second face plate;

a third non-directional microphone system having a third inlet opening in the second face plate for receiving sound and having a third output signal representative of the sound received;

a fourth non-directional microphone system having a fourth inlet opening in the second face plate for receiving sound and having a fourth output signal representative of the sound received; and a second switch connected to the second instrument for switching the second instrument between the non-directional mode and the directional mode.

37. The system of claim 31, wherein the switch has an open position and a closed position, and wherein when the switch is in the closed position, the in-the-ear first instrument is in the directional mode using the first output signal and the second output signal.

38. The system of claim 37, wherein the first instrument includes a summing circuit, in the directional mode the switch connects both the first output signal and the second output signal to the summing circuit, and the summing circuit produces a summed signal.

39. The system of claim 37, wherein when the switch is in the open position, the hearing aid operates in the non-directional mode using one signal from one of the first microphone or the second microphone.

40. The system of claim 31, wherein the switch includes an operator extending outside the shell such that the operator of the switch is manually accessible.

41. The system of claim 31, wherein the first inlet opening and second inlet opening are located in approximately a same plane that is generally horizontal to the ground when the first instrument is located in a wearer's ear.

42. The system of claim 31, wherein the signal connector includes one of a radio frequency transmission or an induction transmission.

* * * * *